US006378169B1

(12) United States Patent
Batten et al.

(10) Patent No.: US 6,378,169 B1
(45) Date of Patent: Apr. 30, 2002

(54) MOUNTING ARRANGEMENT FOR CONSTANT FORCE SPRING BALANCE

(75) Inventors: Thomas F. Batten, Webster; E. Erik Timothy, Macedon, both of NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 09/544,875

(22) Filed: Apr. 7, 2000

(51) Int. Cl.[7] ..... E05D 13/00; E05F 1/00
(52) U.S. Cl. ..... 16/197; 16/198
(58) Field of Search ..... 16/197, 198

(56) References Cited

U.S. PATENT DOCUMENTS

| | | | | | |
|---|---|---|---|---|---|
| 2,191,959 | A | * | 2/1940 | Hirsh | 16/198 |
| 2,262,990 | A | | 11/1941 | Cross et al. | 16/197 |
| 2,644,193 | A | | 7/1953 | Anderberg | 16/197 |
| 3,452,480 | A | * | 7/1969 | Foster | 49/445 |
| 3,869,754 | A | * | 3/1975 | Foster | 16/197 |
| 3,992,751 | A | | 11/1976 | Foster et al. | 16/197 |
| 4,935,987 | A | | 6/1990 | Sterner, Jr. | 16/198 |
| 4,953,258 | A | * | 9/1990 | Mennuto | 16/197 |
| 4,961,247 | A | | 10/1990 | Leitzel et al. | 16/197 |
| 5,157,808 | A | * | 10/1992 | Sterner, Jr. | 16/197 |
| 5,232,208 | A | | 8/1993 | Braid et al. | 267/156 |
| 5,353,548 | A | | 10/1994 | Westfall | 49/446 |
| 5,365,638 | A | * | 11/1994 | Braid et al. | 16/197 |
| 5,463,793 | A | | 11/1995 | Westfall | 16/197 |
| 5,661,927 | A | | 9/1997 | Polowinczak et al. | 49/447 |

* cited by examiner

*Primary Examiner*—Lynne H. Browne
*Assistant Examiner*—John B. Walsh
(74) *Attorney, Agent, or Firm*—Eugene Stephens & Associates

(57) ABSTRACT

A mount for one or more constant force curl springs uses a mounting block secured within a sash shoe channel to support the underside of a lowermost curl spring with a superposed curl spring mounted to counterrotate against an outer convolution of the lowermost spring. Uncoiled free ends of the curl springs pass downward on opposite sides of the mounting block and connect to opposite sides of a sash shoe arranged below the mounting block. This connection is made by laterally sliding the spring ends into slots molded in the sash shoe so that barbs struck and bent from the planes of the free ends of the springs are lodged in widened recesses of the slots to retain the spring ends against upward withdrawal from the spring slots.

37 Claims, 3 Drawing Sheets

MOUNTING ARRANGEMENT FOR CONSTANT FORCE SPRING BALANCE

TECHNICAL FIELD

Hardware for counterbalancing of window sash

BACKGROUND

Curl springs formed of metallic tapes with a spring tendency to curl themselves into coils have a spring force that remains constant throughout their operating range, which makes them desirable for counterbalancing the constant force of gravity on a window sash mounted to move up and down within a window. An optimum way of arranging constant force curl springs is suggested in U.S. Pat. Nos. 5,353,548 and 5,463,793, and other arrangements of constant force curl springs are suggested in recent U.S. Pat. Nos. 2,262,990; 2,644,193; 3,992,751; 4,935,987; 4,953,258; 4,961,247; 5,232,208; and 5,661,927.

When sash shoes are desired with drop-in slots for receiving sash pins lowered into the shoes from above, as a removed sash is replaced in a window, curl springs counterbalancing the shoes must remain clear of a region directly above the shoes when they are locked in place in a shoe channel of a window jamb. This precludes shoe mounting of the curl springs as suggested in U.S. Pat. Nos. 5,353,548 and 5,463,793 and requires that curl springs be mounted in the shoe channels near the top of the window. Prior curl spring mounts that can accommodate sash shoes with drop-in pin slots are unnecessarily cumbersome and expensive. This invention aims at a low cost and effective mount for a plurality of constant force curl springs arranged in a shoe channel of a window jamb so as to provide the necessary clearance for a shoe having a drop-in pin slot.

SUMMARY OF THE INVENTION

Our invention meets these requirements by combining a simple and inexpensive mount for a plurality of curl springs with a low cost and effective way of connecting free spring ends with a sash shoe. A mounting block that can be secured in a shoe channel of a window jamp upholds two or three constant force curl springs loosely retained in the shoe channel. A lowermost curl spring rests on the block and has an uncoiled free end that extends downward past the mounting block to connect to a locking tilt shoe that supports a sash. A second curl spring is positioned in the shoe channel above the lowermost spring and has a free end extending downward past an opposite side of the mounting block to the sash shoe so that the two spring coils counterrotate against each other as the sash shoe moves up and down in the shoe channel. The single mounting block thus supports both springs in a way that avoids sliding contact between metal surfaces by simply counterrotating the spring coil peripheries against each other as the sash shoe moves up and down.

A third curl spring can be mounted above the second curl spring with the aid of a bearing block that separates the second and third springs so that a free end of the third spring can join the free end of the second spring in extending down past the mounting block to the sash shoe. The mounting block has at least one upward extension positioned to prevent any sliding metal contact between the outer periphery of the lowermost curl spring and the free end of the second spring passing downward alongside the lowermost curl spring.

Connections between the free spring ends and the sash shoe are made by striking barbs from the free spring ends so that the barbs lodge in widened recesses of slots molded into the sash shoe. The spring ends can be laterally inserted edgewise into the spring retaining slots of the sash shoe so that the barbs enter and interlock with recesses of the slots, and the spring ends are thereby held against vertical withdrawal from the shoe slots. Once the assembly is mounted in a shoe channel, walls of the channel retain the springs and the spring ends against any lateral withdrawal from the shoe slots.

DRAWINGS

DETAILED DESCRIPTION

Figure 1:
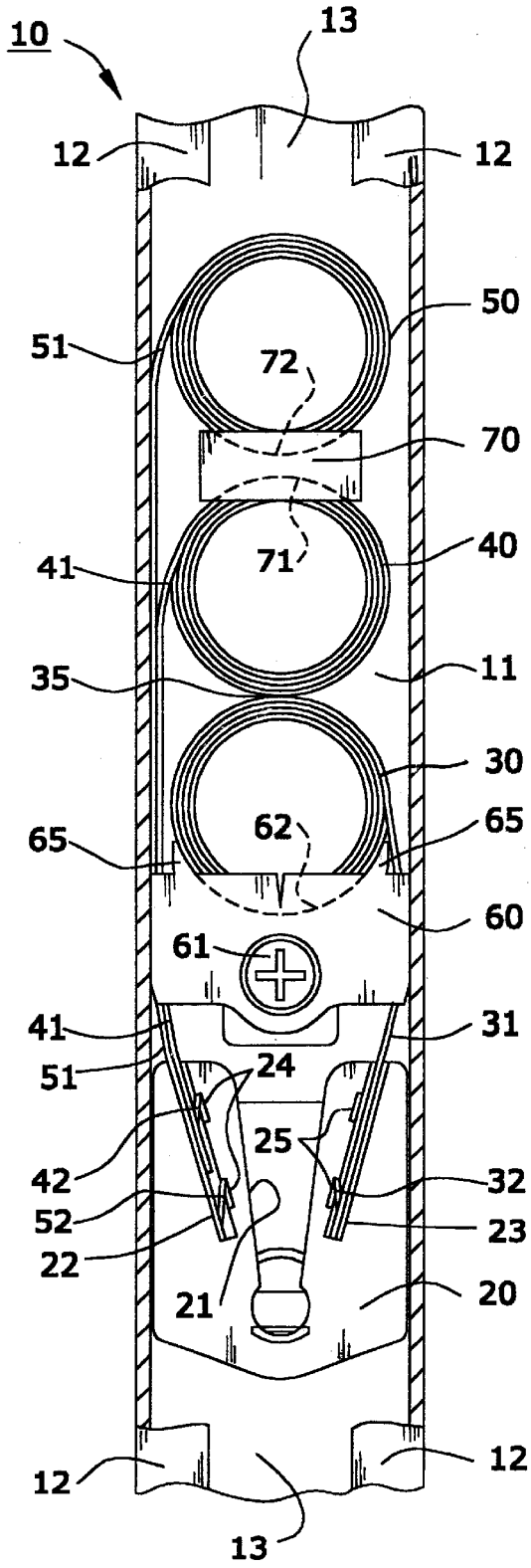
FIG. 1 is a partially cutaway, fragmentary elevational view of a window jamb showing a shoe channel in which the inventive mount is arranged to support three curl springs connected to a sash shoe having a drop-in pin slot.

All the preferred components of the inventive mounting arrangement for constant force curl springs are shown in FIG. 1, where the illustrated components are arranged within a shoe channel 11 of a window jamb 10. For simplicity of illustration, FIG. 1 shows a single shoe channel 11 cut away from window jamb 10, which often includes a pair of shoe channels. Channel walls 12, which are also cut away to reveal the spring mount components, straddle a slot 13 that extends vertically of shoe channel 11 and allows a sash pin (not shown) to enter shoe channel 11 and engage sash shoe 20. Shoe 20 moves vertically within channel 11 and has a drop-in sash pin slot 21. Shoe 20 also preferably locks within channel 11 in a generally known way when a shoe supported sash is tilted. All the components of spring mount 10 are preferably made reversible so that any component can be used on either side of a window without requiring any right-handed or left-handed parts.

Curl springs 30, 40, and 50 are illustrated in FIG. 1 as counterbalancing sash shoe 20; but in some circumstances, only a single curl spring 30 may be necessary, or a pair of curl springs 30 and 40 may be adequate. This depends on the weight of a sash being supported and the spring force of the curl springs being used.

Figure 2:
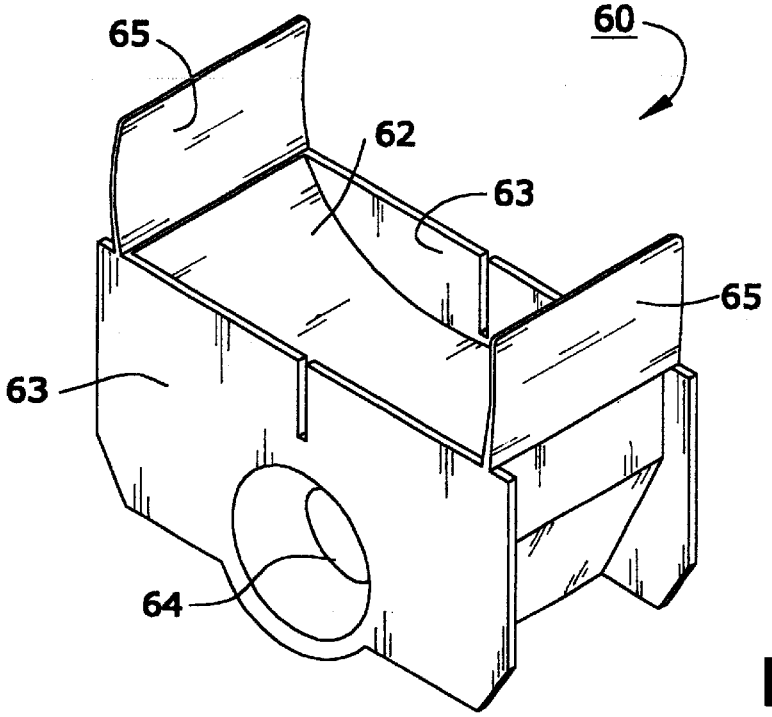
FIG. 2 is an isometric view of a preferred embodiment of a spring mount for use in the invention.

Whatever the number of curl springs being used, they are supported or upheld by a single mounting block 60 that is preferably molded of resin and secured within channel 11 by a fastener such as screw 61. Mounting block 60 is shown in more detail in FIG. 2, which reveals a preferred concave cylindrical surface 62 disposed to engage an outer periphery of an outer convolution of coil spring 30. A pair of guide walls 63 extend above cylindrical surface 62 to straddle convolutions of spring coil 30 and help retain spring coil 30 in an operating position.

Configurations other than concave and cylindrical can be substituted for mount surface 62, the requirement being that mount 60 engages the underside of spring coil 30 to support or uphold spring 30 freely within channel 11 so that spring coil 30 can rotate against mounting block 60 as a free end 31 of spring 30 uncoils and recoils. Mounting element 60 is preferably molded of resin material to produce reasonably low friction as spring coil 30 rotates against surface 62. Mounting block 60 is also preferably molded with an opening 64 configured to receive mounting screw 61.

To avoid any sliding metal-to-metal contact between the outer convolution of spring coil 30 and free end regions 41 or 51 of spring coils 40 and 50, mounting element 60 preferably has at least one thin, upwardly extending projection 65, which is configured to extend upward alongside an outer convolution of lowermost spring coil 30. Projection 65 then separates free end 41 of superposed spring coil 40 from the outer convolution of lowermost spring coil 30 as free end 41 moves up and down during vertical movement of sash shoe 20. For ease of assembly, mounting block 60 preferably has a pair of upward projections 65, either one of which is available to separate a free end of a superposed curl spring from the outer convolution of the lowermost curl spring regardless of the orientations of the respective springs or the orientation of mounting block 60.

Figure 3:
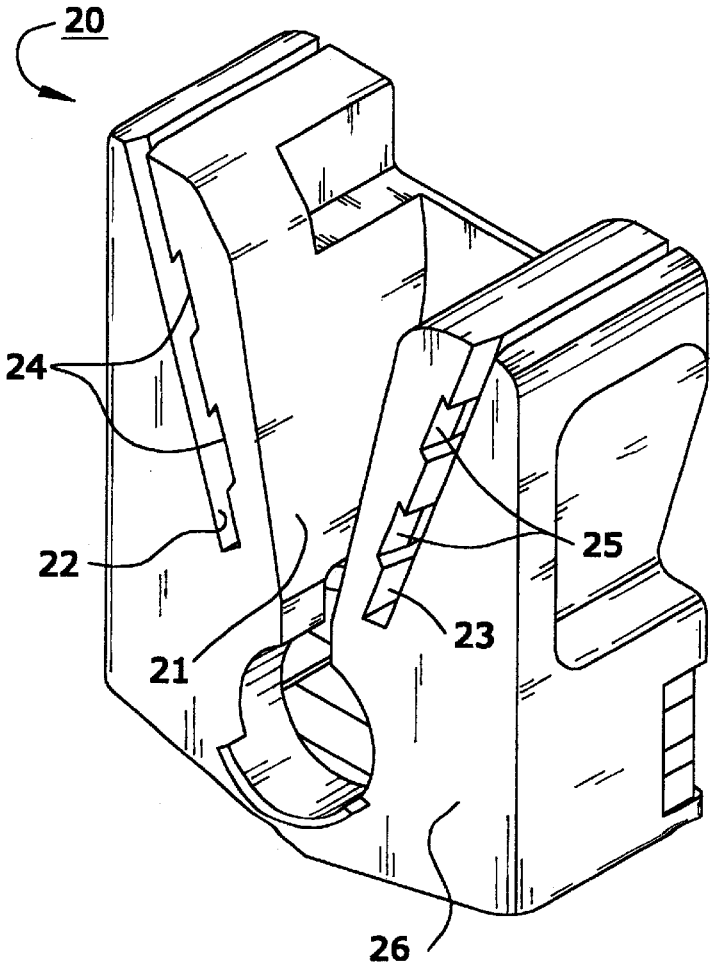
FIG. 3 is an isometric view of a preferred embodiment of a sash shoe having a drop-in pin slot and a preferred way of interconnecting with free ends of curl springs.

For purposes of this invention, the significant part of sash shoe 20, as best shown in FIG. 3, is a pair of spring mounting slots 22 and 23 arranged on opposite sides of drop-in pin slot 21. Spring end slots 22 and 23 are preferably open at one face side 26 of shoe 20, and face side 26 preferably is a sash facing side of shoe 20. This allows spring ends 31, 41, and 51 to be inserted laterally into the open sides of respective slots 23 and 22 from the face side 26 of shoe 20. Slots 22 and 23 are preferably formed by molding shoe 20 of resin material so that slots 22 and 23 are wide enough to accommodate one or two of the spring ends 31, 41, and 51. The location of spring coils 30, 40, and 50 within walls 12 of channel 11 not only retains coils 30, 40, and 50 within channel 11, but also holds free ends 31, 41, and 51 within channel 11. Once the free ends of the springs are lodged in slots 22 and 23, and the assembly is mounted within channel 11, spring ends 31, 41, and 51 cannot escape laterally from the open sides of slots 22 and 23.

Figure 4:
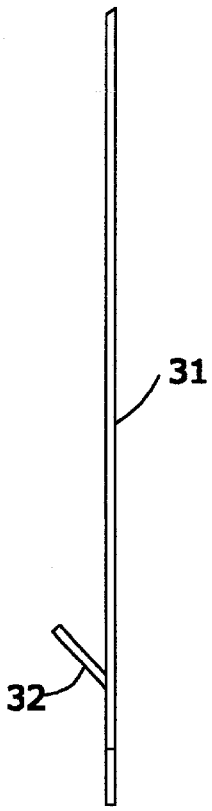
FIGS. 4 and 5 are fragmentary elevational side and face views of a preferred way of terminating the free end of a curl spring for connection with a sash shoe.
Figure 5:
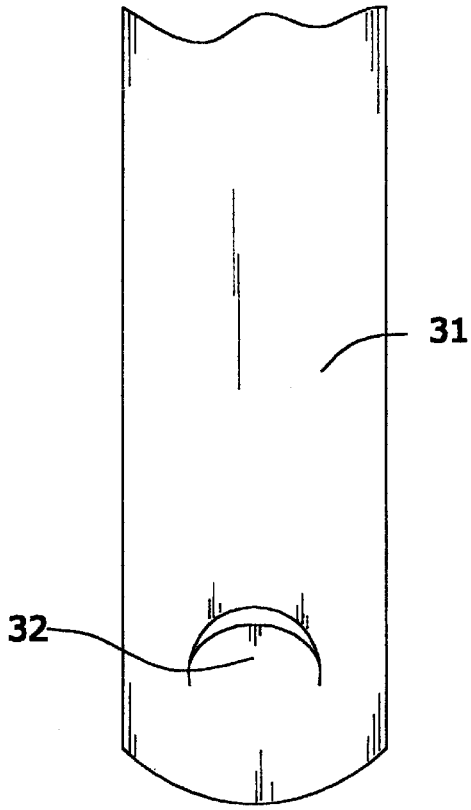

To retain the spring ends against vertical withdrawal from slots 22 and 23, each spring end region has a struck-out barb 32, as illustrated in FIGS. 4 and 5 for spring end 31. Spring ends 41 and 51 have similar barbs 42 and 52 that are preferably identical to illustrated barbs 32 and are shown in FIG. 1. Barbs 32, 42, and 52 preferably are half-circular in shape, are bent from the plane of the spring end from which they are struck, and are centered within each respective spring end. Barbs 32, 42, and 52 can also have other shapes and locations on spring ends.

Slots 22 and 23 have widened recesses 24 and 25 that are shaped to receive barbs 32, 42, or 52 of respective spring ends. Once a spring end is slid laterally into one of the slots 21 and 22 so that a barb 32, 42, or 52 that is struck out from the plane of the spring end is lodged in one of the recesses 24 and 25, the spring end is trapped in shoe 20 and held against vertical withdrawal from one of the slots 22 and 23.

Each slot 22 and 23 preferably has a pair of recesses 24 or 25, and these are preferably configured to angle obliquely upward from the respective slots 22 and 23 so that each recess 24 or 25 can receive and interlockingly engage one of the struck-out barbs 32, 42, and 52. When two springs are used, spring ends 31 and 41 occupy opposite slots 22 and 23 with barbs 32 and 42 locked into respective recesses 24 and 25. This causes spring coils 30 and 40 to counterrotate as their free ends unwind and rewind with movement of shoe 20 downward and upward in shoe channel 11. Such counterrotation rolls the peripheries of the outer convolutions of spring coils 30 and 40 against each other at their line of contact 35, without any sliding metal-to-metal contact.

Barbs 32, 42, and 52 are preferably formed on the same side of each curl spring so that recesses 24 and 25 can be located on the same corresponding side of slots 22 and 23. Whether the barbs 32, 42, and 52 are struck or bent inwardly or outwardly relative to the recoil tendency of each curl spring is a matter of design choice involving spring manufacturing techniques and the desired configuration of sash shoe 20 and slots 22 and 23.

The support provided by mounting block 60 to uphold spring coils 30 and 40 within channel 11 and prevent any downward movement of the spring coils within channel 11 thus allows both spring coils 30 and 40 to rotate freely without any central axles or hub supports. Walls 12 of channel 11 retain spring coils 30 and 40 loosely within channel 11 and prevent any lateral escape of springs 30 and 40 from channel 11. The only frictional contact with springs 11 is caused by resin surfaces of mounting block 60 and the walls of channel 11, both of which offer low friction and non-destructive contact with spring coils 30 and 40.

When a third spring coil 50 is needed, it is mounted above spring coil 40 as shown in FIG. 1. Mounting spring coil 50 to counterrotate with spring coil 40, as spring coil 40 counterrotates against a periphery of spring coil 30, would leave the problem of free end 51 of spring coil 50 sliding downward past spring coil 40. This could result in sliding metal-to-metal contact, which is to be avoided. The preferred solution, therefore, is to mount spring coil 50 so as to co-rotate with spring coil 40. This locates free end 51 of spring 50 alongside free end 41 of spring 40 and disposes free ends 41 and 51 within slot 22 of shoe 20, as shown in FIG. 1. Barbs 42 and 52 then lock into respective upper and lower recesses 24 of slot 22. Projection 65 of mounting block 60, which is disposed to prevent sliding metal-to-metal contact between spring coil 30 and spring end 41, also holds spring end 51 away from spring coil 30, since spring end 51 is further removed from coil 30 than spring end 41. No metal-to-metal sliding contact occurs between free ends 51 and 41, since they move together.

Figure 6:
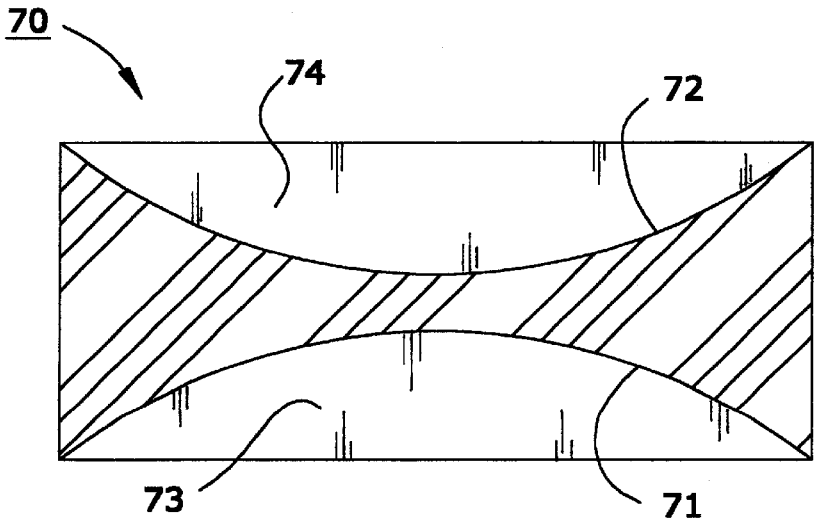
FIG. 6 is a cross-sectional view of a preferred embodiment of a spring separating bearing block used in the invention.

Sliding metal-to-metal contact from the co-rotation of spring coils 50 and 40 is eliminated by use of a bearing block 70, as shown in FIG. 6, which is interposed between coils 40 and 50, as shown in FIG. 1. Spring separator block 70 preferably includes a downward facing cylindrically concave surface 71 and an upward facing cylindrically concave surface 72, but other configurations can be given to surfaces 71 and 72. Each of these surfaces engages a peripheral convolution of a curl spring coil so that a peripheral spring surface can slide against a surface of bearing block 70 with acceptably low friction. To ensure this, separator block 70 is preferably molded of resin material.

Block 70 also preferably includes side or guide walls 73 and 74 disposed for straddling the coils of curl springs engaging the bearing surfaces 71 and 72. Guide surfaces 73 and 74 retain bearing block 70 in place between spring coils 40 and 50 as they unwind and rewind during movement of sash shoe 20. Like the spring coils themselves, bearing block 70 is also retained within shoe channel walls 12 and is held snuggly between springs 40 and 50 by the spring force tending to pull spring coil 50 downward against spring coil 40. Downward pull of the spring coils, including that of spring coil 30, is resisted by a secure attachment of mounting block 60 to shoe channel 11.

The combination of features explained above makes spring mount 10 both inexpensive and effective. Spring coils can be assembled to mounting block 60 and have their free ends secured in shoe 20, and then such a subassembly can be slid endwise into shoe channel 11 and secured in operating position by driving screw 61 through mounting block 60 and into a rear wall of channel 11. Not only are the components of mount 10 inexpensively made, but the assembly and securing of mount 10 in place within a shoe channel is quick and efficient.

We claim:

1. A system mounting a plurality of constant force curl springs in a shoe channel of a window to counterbalance a sash shoe running vertically within the channel, the system comprising:

a. a mounting block secured in the shoe channel to engage and support a first spring coil above the mounting block;

b. a second spring coil arranged within the shoe channel above the first spring coil so that outer convolutions of the first and second spring coils engage each other;

c. a free end of the spring of the first coil being connected to one side of a sash shoe arranged within the shoe channel below the mounting block, and a free end of the spring of the second coil being connected to an opposite side of the sash shoe so that the first and second spring coils counterrotate against each other as the shoe moves up and down within the channel;

d. each of the free spring ends having a barb cut from spring material and bent away from spring material to form a spring retainer; and e. the shoe having molded slots positioned and dimensioned to receive the first and second spring ends, the slots having widened recess regions configured to receive the barbs and thereby hold the spring ends from vertical withdrawal from the slots.

2. The system of claim 1 wherein the recess regions are formed on one side of each of the slots, and the barbs are bent in orientations that direct the barbs into the recess regions when the spring ends are retained in the slots.

3. The system of claim 1 including a third spring coil arranged within the shoe channel above the second spring coil, a free end of the spring of the third coil being retained with the free end of the second spring coil in a slot in the shoe, and a bearing block being positioned between the second and third spring coils to prevent sliding contact between the second and third spring coils.

4. The system of claim 3 wherein the shoe slot receiving the free ends of the springs of the second and third coils has a pair of recess regions disposed for respectively receiving barbs of the free ends.

5. The system of claim 1 wherein the mounting block has a projection extending upward alongside the first spring coil to separate the free end of the second spring coil from the outer convolution of the first spring coil to prevent sliding contact between the first spring coil and the free end of the second spring coil during vertical movement of the shoe.

6. The system of claim 1 wherein the spring coils and spring ends are retained by walls of the shoe channel from horizontal movement out of the shoe slots.

7. A shoe channel mount supporting constant force spring coils counterbalancing a sash shoe within a window, the mount comprising:

a. first and second spring coils arranged within the shoe channel to engage each other and counterrotate against each other as a shoe moves up and down in the channel;

b. free end regions of the springs of the first and second coils being connected to opposite sides of the sash shoe;

c. the first and second spring coils being supported in the shoe channel by a mounting block secured to the shoe channel beneath the first spring coil;

d. the shoe having a pair of slots receiving the respective free end regions of the first and second spring coils; and e. the shoe slots having recesses arranged to receive and interlock with retaining barbs struck from the free end regions to hold the free end regions against retracting upwardly from the sash shoe.

8. The mount of claim 7 wherein the recesses are arranged on one side of each of the slots, the free end regions are disposed in the slots, and the barbs are bent from the free end regions to extend into the recesses.

9. The mount of claim 7 wherein the mounting block has a thin projection extending upward alongside the first spring coil to keep the free end region of the second spring coil from sliding against the first spring coil when the sash shoe moves up and down in the shoe channel.

10. The mount of claim 7 including a third spring coil arranged within the shoe channel above the second spring coil and separated from the second spring coil by a bearing block shaped to engage outer convolutions of the second and third spring coils and be retained within the shoe channel between the second and third spring coils.

11. The mount of claim 10 wherein the shoe slot retaining the free end region of the second spring coil also retains a free end region of the third spring coil.

12. The mount of claim 7 wherein each of the shoe slots has a pair of vertically spaced recesses to receive and hold retaining barbs of a pair of free end regions.

13. A plural curl spring mount comprising:

a. a mounting block secured to a window jamb within a shoe channel to engage a lowermost curl spring confined within the shoe channel and to support the lowermost curl spring against downward movement;

b. a second curl spring confined within the shoe channel above the lowermost curl spring so that outer convolutions of the lowermost and the second curl springs engage each other; and c. free end regions of the lowermost and second springs extending downward past opposite sides of the mounting block to connect to a sash shoe so that the lowermost and the second curl springs counterrotate against each other as the sash shoe moves up and down.

14. The mount of claim 13 wherein the mounting block has a thin projection extending upward alongside the outer convolution of the lowermost curl spring to separate the free end region of the second curl spring from the outer convolution of the lowermost curl spring as the sash shoe moves up and down.

15. The mount of claim 13 including a third curl spring confined within the shoe channel above the second curl spring and separated from the second curl spring by a bearing block that engages outer convolutions of the second and third curl springs.

16. The mount of claim 15 wherein a free end region of the third curl spring accompanies the free end region of the second curl spring in passing by the mounting block and connecting to the sash shoe.

17. A multiple spring mount arranged within a shoe channel of a window jamb and comprising:

a. a pair of curl springs arranged one above the other in contact with each other;

b. the curl springs being confined within the shoe channel and thereby restrained from lateral movement;

c. a mounting block secured to the jamb within the shoe channel to engage an underside of the lowermost curl spring and to restrain both curl springs against downward movement; and d. free ends of the curl springs extending below opposite sides of the mounting block where the curl springs are connected to a sash shoe so that the curl springs counterrotate against each other as the shoe moves up and down in the shoe channel beneath the mounting block.

18. The mount of claim 17 wherein a projection extends upward from the mounting block to prevent a downwardly extending length of the second spring from sliding against an outer convolution of the lowermost spring.

19. The mount of claim 17 including a third curl spring arranged above the pair of curl springs within the shoe channel, and a bearing block separating the third curl spring from sliding contact with an uppermost one of the pair of curl springs.

20. The mount of claim 19 wherein a downwardly extending length of the third curl spring is connected to the shoe with the downwardly extending length of the second spring.

21. A system mounting a plurality of constant force curl springs in a shoe channel of a window to counterbalance a sash shoe running vertically within the channel, the system comprising:

a. a mounting block secured in the shoe channel to engage and support a first spring coil above the mounting block;

b. a second spring coil arranged within the shoe channel above the first spring coil so that outer convolutions of the first and second spring coils engage each other; and c. a free end of the spring of the first coil being connected to one side of a sash shoe arranged within the shoe channel below the mounting block and a free end of the spring of the second coil being connected to an opposite side of the sash shoe so that the first and second spring coils counterrotate against each other as the shoe moves up and down within the channel.

22. The system of claim 21 including a third spring coil confined within the shoe channel above the second spring coil and supported above the second spring coil by a bearing block interposed between the second and third spring coils.

23. The system of claim 22 wherein the bearing block has opposed concave surfaces engaging outer convolutions of the second and third spring coils and arranged between a pair of side walls straddling the spring coils and retaining the bearing block between the second and third spring coils.

24. The system of claim 22 wherein a free end of the spring of the third coil connects to the sash shoe next to the free end of the spring of the second coil.

25. The system of claim 21 wherein the mounting block is molded of resin and shaped to fit within the shoe channel at a mount elevation for the spring coil, a screw secures the mounting block to the shoe channel, an upward facing surface of the mounting block is cylindrically concave to engage a periphery of the first spring coil, and the mounting block has a pair of guide walls extending above the cylindrical surface to straddle convolutions of the first spring coil.

26. A system of retaining a free end of a constant force curl spring in a sash shoe running vertically within a shoe channel of a window, the system comprising:

a. the free spring end having a barb cut from spring material and bent away from spring material to form a spring retainer;

b. the shoe having a molded slot positioned and dimensioned to receive the spring end, the slot having a widened recess region configured to receive the barb and thereby hold the spring end from vertical withdrawal from the slot; and c. the slot having a plurality of widened recesses configured to receive the barbs of a plurality of free spring ends lodged in the slot.

27. A shoe channel mount supporting constant force spring coils counterbalancing a sash shoe within a window, the mount comprising:

a. first and second spring coils arranged within the shoe channel to engage each other and counterrotate against each other as a shoe moves up and down in the channel;

b. free end regions of the springs of the first and second coils being connected to opposite sides of the sash shoe; and c. the first and second spring coils being supported in the shoe channel by a mounting block secured to the shoe channel beneath the first spring coil and above the shoe.

28. The mount of claim 27 wherein the mounting block has a thin projection extending upward alongside the first spring coil to keep the free end region of the second spring coil from sliding against the first spring coil when the sash shoe moves up and down in the shoe channel.

29. The mount of claim 27 including a third spring coil arranged within the shoe channel above the second spring coil and separated from the second spring coil by a bearing block shaped to engage outer convolutions of the second and third spring coils and be retained within the shoe channel between the second and third spring coils.

30. The mount of claim 27 wherein the mounting block is molded of resin and shaped to fit within the shoe channel at a mount elevation for the spring coil, a screw secures the mounting block to the shoe channel, an upward facing surface of the mounting block is cylindrically concave to engage a periphery of the first spring coil, and the mounting block has a pair of guide walls extending above the cylindrical surface to straddle convolutions of the first spring coil.

31. A system retaining free end regions of each of a plurality of constant force spring coils in a sash shoe arranged for moving vertically within a shoe channel of a window jamb, the system comprising:

a. the shoe having a pair of slots receiving respective free end regions of a pair of the spring coils;

b. the slots being open along one face of the shoe so that the free end regions can be moved laterally into the slots from the one face of the shoe;

c. the shoe slots having recesses arranged to receive and interlock with retaining barbs struck from the free end regions to hold the free end regions against retracting upwardly from the shoe; and d. each of the shoe slots having a pair of vertically spaced recesses to receive and hold retaining barbs of a pair of free end regions.

32. A shoe channel mount supporting a constant force spring coil counterbalancing a sash shoe within a window, the mount comprising:

a. a molded resin element shaped to fit within the shoe channel at a mount elevation for the spring coil;

b. a screw securing the resin element to the shoe channel;

c. an upward facing surface of the resin element being cylindrically concave to engage a periphery of the spring coil;

d. the resin element having a pair of guide walls extending above the cylindrical surface to straddle convolutions of the spring coil; and e. a free end region of the spring coil extending below the resin element to connect. with a sash shoe movable vertically within the shoe channel.

33. The mount of claim 32 wherein the sash shoe has a slot receiving the free end region, the slot has a side recess, and a barb struck from the free end region is lodged in the recess to retain the free end region against moving upward out of the slot.

34. A system of retaining an end region of a constant force curl spring in a sash shoe running vertically within a shoe channel of a window, the system comprising:

a. the end region of the spring having a through cut spaced from an end of the spring;

b. a plane barb defined by a configuration of the cut being bent from a plane of the end region so that a plane of the barb is oblique to the plane of the end region;

c. a bend at an intersection of the plane of the barb and the plane of the end region of the spring being spaced from the end of the spring;

d. a cut end of the barb forming a spring retainer being spaced farther from the free end of the spring than the bend; and e. the shoe having a molded slot positioned and dimensioned to receive the end region of the spring, the slot having a widened recess region configured to receive the barb and thereby hold the spring end region from vertical withdrawal from the slot.

35. The system of claim 34 wherein the widened recess is formed in a mid region of the slot and arranged on only one side of the slot.

36. A system retaining end regions of each of a plurality of constant force spring coils in a sash shoe arranged for moving vertically within a shoe channel of a window jamb, the system comprising:

a. the shoe having a pair of slots receiving respective end regions of a pair of the spring coils;

b. the slots being open along one face of the shoe so that the end regions can be moved laterally into the slots from the one face of the shoe;

c. the shoe slots having recesses arranged to receive and interlock with retaining barbs struck from the end regions to hold the end regions against retracting upwardly from the shoe; and d. the retaining barbs being formed to lie in planes oblique to planes of the end regions, with the planes of the barbs intersecting planes of the end regions along lines spaced from ends of the springs, and the barbs extending from the intersection lines in a direction away from the ends of the springs.

37. The system of claim 36 wherein the recesses are arranged on one side of each slot, and the retaining barbs are bent from the end regions in a direction that lodges the retaining barbs in the recesses.

* * * * *